United States Patent [19]

Forin et al.

[11] 3,999,360

[45] Dec. 28, 1976

[54] MACHINE FOR THE TEXTURATION OF TEXTILE YARN

[75] Inventors: Roger Guy Forin; Jean-Claude Depeuble, both of Roanne, France

[73] Assignee: Ateliers Roannais de Constructions Textiles, Roanne, France

[22] Filed: Feb. 23, 1976

[21] Appl. No.: 660,681

[30] Foreign Application Priority Data

Feb. 25, 1975 France ..... 7506785

[52] U.S. Cl. ..... 57/34 HS; 34/152; 57/106; 57/157 TS; 432/59

[51] Int. Cl.[2] ..... D02G 1/02; F27B 9/28

[58] Field of Search ..... 57/34 HS, 34.5, 106, 57/157 TS; 28/62; 34/16, 151, 152, 154, 155, 159; 432/8, 59

[56] References Cited

UNITED STATES PATENTS

| | | | |
|---|---|---|---|
| 3,237,392 | 3/1966 | Crouzet | 57/157 TS |
| 3,283,414 | 11/1966 | Crouzet | 34/154 X |
| 3,293,838 | 12/1966 | Batsch | 57/34 HS |
| 3,501,904 | 3/1970 | Batsch | 57/34 HS |
| 3,584,450 | 6/1971 | Crouzet | 57/34 HS |
| 3,782,890 | 1/1974 | Howorth | 432/59 |
| 3,839,853 | 10/1974 | McKenzie | 57/34 HS |
| 3,942,312 | 3/1976 | Venot | 57/34 HS |
| 3,946,546 | 3/1976 | Venot | 57/34 HS |

FOREIGN PATENTS OR APPLICATIONS 2,363,160 5/1975 Germany

*Primary Examiner*—John Petrakes
*Attorney, Agent, or Firm*—Stevens, Davis, Miller & Mosher

[57] ABSTRACT

An improvement in false-twist yarn texturing machine of the type having a plurality of treatment positions each of which includes a yarn feed device, a first yarn delivery carriage, a heating tube, a cooling tube, a false-twist spindle, a second yarn delivery carriage, and a winding device, as well as an air blowing device located at the inlet of the heating tube and a suction device for removing smoke at the outlet of the heating tube, the improvement being a tubular connection between the outlet of the heating tube and the inlet of the cooling tube, which connection is pivotally mounted so that one end thereof can temporarily be engaged with the outlet of the heating tube, and the cooling tube is slidably mounted to permit sliding in the direction of its own longitudinal axis, the other end of the tubular connection being connected to the inlet of the cooling tube so that pivoting of the tubular connection may be caused by sliding the cooling tube in the direction of the tubular connection. The heating tube and cooling tube are typically vertically oriented so that the tubular connection is approximately U-shaped.

8 Claims, 4 Drawing Figures

Figure 1:
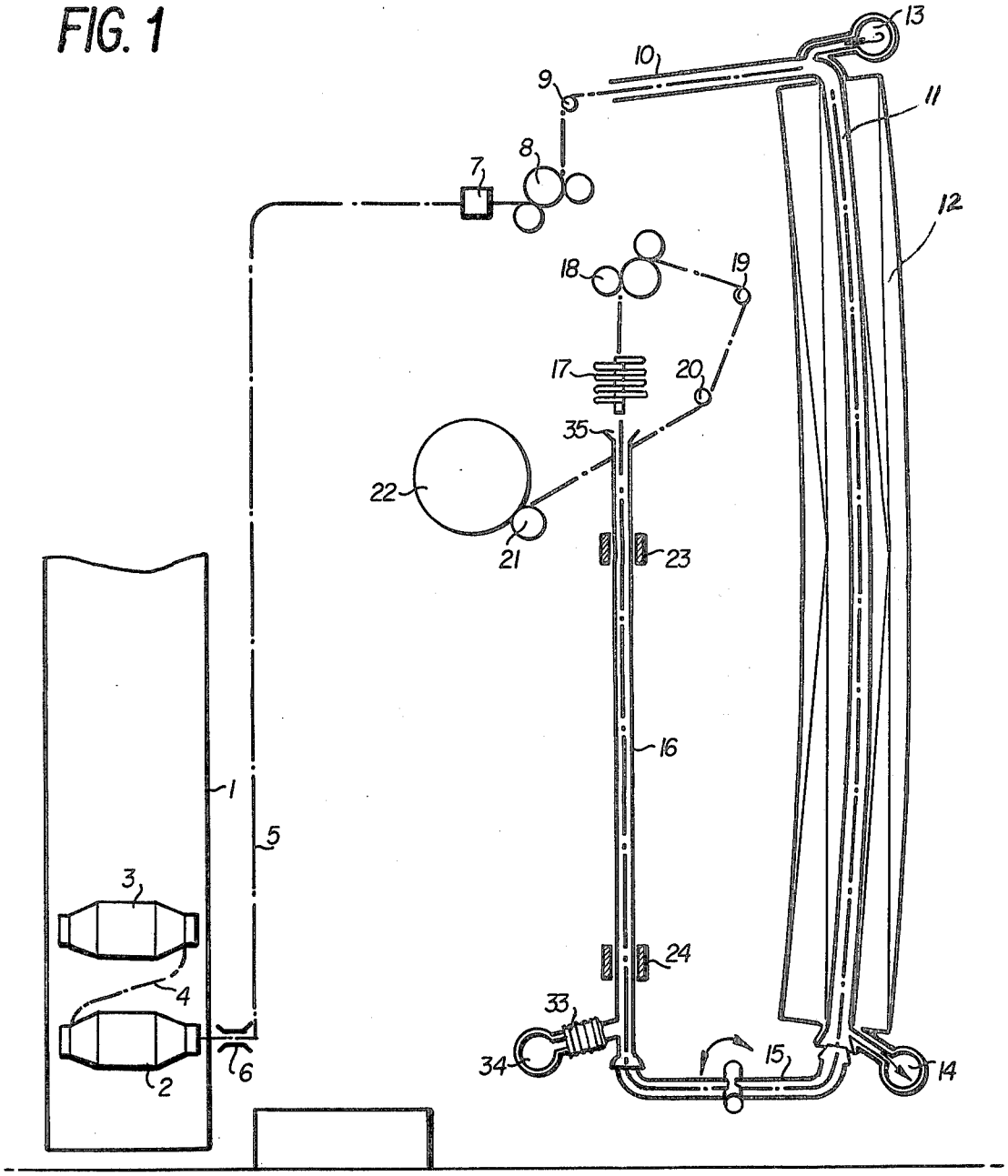

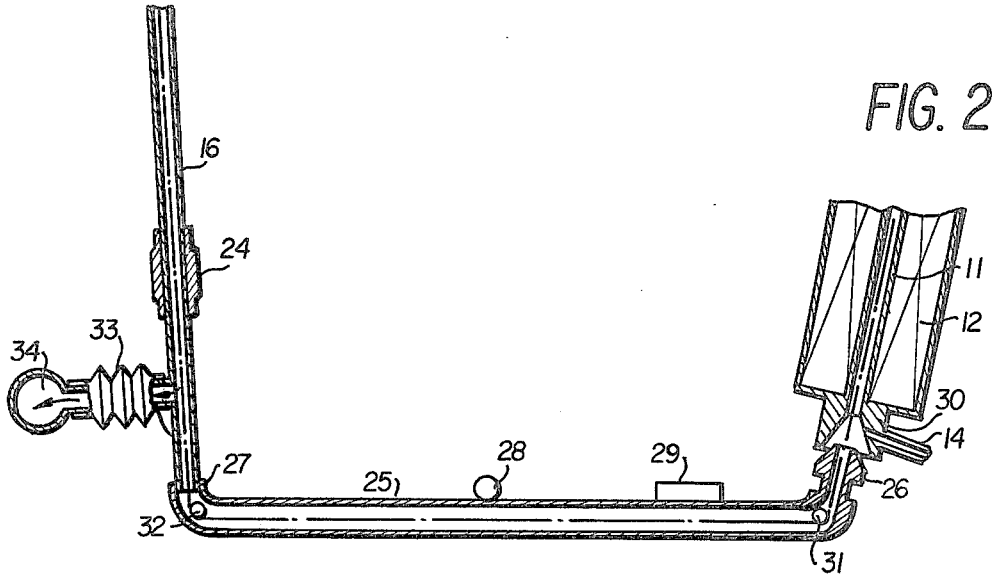
FIG. 2
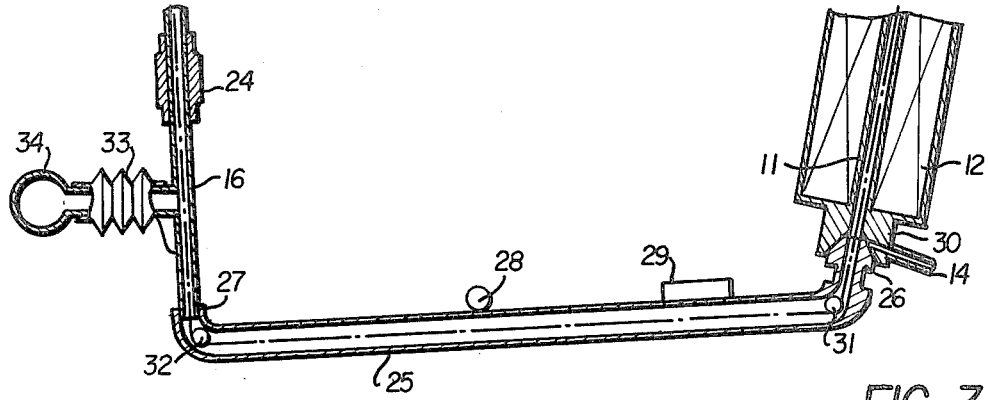
FIG. 3
FIG. 4
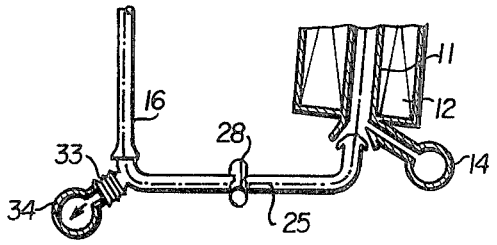

MACHINE FOR THE TEXTURATION OF TEXTILE YARN

This invention relates to an improved machine for the texturation of a textile yarn, more particularly by false twist and the invention concerns primarily a machine having improved means for transferring the yarn from a feeding station to a station of treatment by texturation.

The method of texturation by false twist is itself well known. Schematically this method comprises in continuous operation the steps of overtwisting a yarn by means of a convenient spindle, heating this yarn while same is receiving the twist, cooling, then untwisting the yarn for an amount equal, but reversely, to the twist originally received. In an improved embodiment, the yarn can be subjected, also in continuous operation but in the released state, to a second re-fixing heat treatment, the primary purpose of which is to increase the voluminosity of the yarn and to decrease the extensibility and the torque thereof.

An ordinary machine for texturation by false twist generally has a plurality of yarn treatment positions, each one of these positions including primarily, in the order named: a yarn feeding device, a yarn delivery carriage, a treatment oven consisting of a heated tube that is possibly curved, a cooling zone, a false twist spindle, a second delivery carriage and a yarn winding device.

As the treated yarn includes a lubricant that tends to vaporize during the heat treatment, the texturation machine is also provided with air blowing parts located at the inlet of the heated tube, and with loaded air suction parts located at the outlet of said tube, and the air that is thus sucked in may be recirculated within the blowing part, in order to decrease the consumption of energy, as described with the French Pat. No. 1,363,920 which corresponds to U.S. Pat. No. 3,283,414. Due to the high speeds used on modern machines, it is absolutely necessary to cool substantially the yarn between the delivery thereof from the heating organ and the feeding of the yarn into the false-twist spindle. To do this, natural cooling of the yarn by passage through air is frequently used, either along a direct path or along a circuitous path. See, for example, French Pat. No. 1,583,799 which corresponds to U.S. Pat. No. 3,584,450. However, when higher speeds of the yarn are used, i.e. speeds higher than four hundred meters/minute, it has been found that this solution is not a very practical one, as substantial cooling lengths are involved, resulting therefore in a considerable increase of machine volume. In order to accelerate this cooling, it has been suggested, for example in U.S. Pat. No. 3,237,392, to allow this yarn to pass through a tube with which the yarn may come into contact to promote heat exchange, and moreover, this tube can be provided with fins so as to increase the exchange surface area. This solution, that has been called "accelerated cooling," has moreover the advantage from a theoretical point of view, of being consistent with a step of pneumatic thread-up of the yarn, i.e. a step in which the yarn is inserted through the various organs by means of a jet of compressed air or by means of suction.

It is easy to insert the yarn to be treated within the heating tube, more particularly by means of compressed air or suction. On the other hand, in the present installations of the type described above, due to the provision of the necessary smoke suction element at the outlet of the heating tube, it is not possible to allow the yarn to pass automatically and continuously within the cooling tube, since the access of the tube outlet must be free for the normal operation of the smoke suction device and moreover, the tube outlet must be left open to the air to enable the suction device to exhaust the smoke, since it would otherwise condense within the cooling tube. In other words, it is desirable to have no break of continuity between the cooling tube and the heating tube.

French Pat. No. 1,537,977, which corresponds to U.S. Pat. No. 3,501,904 describes a heating treatment zone in which the heating tube and the cooling tube are connected in a U-shaped arrangement. In this device, the smoke suction zone is connected at the low part of the U-leg constituting the heating tube, and consequently the pneumatic thread-up of the yarn is disturbed especially with fine denier yarns, and especially because of the loss of head at the level of the heating tube-suction zone connection, said loss inducing loss of suction at the entrance of the heating tube.

In view of this, the thread-up step becomes more complicated. These drawbacks are overcome by the present invention.

This invention relates to a false twist texturation machine for textile yarn, comprising a plurality of working positions of the type in which each position comprises essentially in the order named, a yarn feeding device, a first yarn delivery carriage, a heating tube, a quick cooling tube, a false-twist spindle, a second yarn delivery carriage and a winding device, an air blowing device disposed at the inlet of the heating tube, and a smoke suction device disposed at the outlet of said heating tube. The improvement in accordance with the invention is characterized in that said machine includes a tubular connection part, between the heating tube and the cooling tube, and including:

means permitting pivoting said connecting part around an axis that is approximately orthogonal to the longitudinal axis of the heating tube, for bringing momentarily the end of said part into contact or engagement with the outlet port of said heating tube, and means for allowing the cooling tube to slide in a plane parallel to its own axis, said improvement also characterized in that the end of said cooling tube is integral with the corresponding end of the connecting tube.

In a practical embodiment, the cooling tube is approximately parallel to the heating tube, and the connecting tubular part is approximately U-shaped, one leg of the U being intended, on pivotal motion, to come into close contact or engagement with the outlet port of the heating tube during the thread-up step, and the other leg being permanently connected to the inlet of the cooling tube.

Preferably, the aperture of the smoke suction section located at the outlet of the heating tube is obturated during the pivoting of the connecting tube, when it is coming into closed contact or engagement with the outlet of the heating tube.

In an improved form, the connecting tubular part has also smoke suction means conveniently located on the leg of the U, connected with the inlet of the cooling tube, to exhaust the smoke that is taken along together with the yarn during the travel of the latter within the connecting part.

The manner in which the invention can be performed and the advantages resulting therefrom will be better understood from the following example illustrating as an indication, without limitation, an embodiment of the invention, with reference to the attached drawings, in which:

FIG. 1 is a sectional view showing diagrammatically a position of a false twist a texturation machine, and FIGS. 2 and 3 are detailed views of the connecting tubular part, respectively:

in the rest position, FIG. 2, during the thread-up operation, FIG. 3

FIG. 4 is a detailed view of another connecting tubular part.

The machine described hereafter is more particularly adapted for false twist texturation of synthetic yarns at speeds of about six hundred meters/minute, and more. This machine comprise a plurality of positions, located side by side and on both faces of the machine, this arrangement being already known. Each position comprises, in the order named:

A creel 1, illustrated separately, can hang from the top of the machine, said creel carrying two bobbins 2 and 3 for the yarn, one bobbin 2 being operative, the other one 3 being inoperative, these bobbins being connected together by a transfer tail 4.

The yarn 5 leaving bobbin 2 passes over a disc tensionner 6, a yarn-cutter 7, and reaches a first yarn delivery 8, of apron type as shown or of another type, for instance the roller-against-roller or capstan types.

The yarn then passes over a counter-guide 9, and comes within a rectilinear tube 10 connected to the inlet of the heating tube 11 located within heater 12. The heating device 11 is a tube of stainless steel having a diameter of about eight millimeters and a length of about 2.5 meters, with a sweep of about fifty millimeters. This tube is conventionally heated by electrical power or by a convenient heating fluid, and is set at the temperature desired.

At the inlet of the heating tube 11, opposite tube 10, opens a wind tunnel tube 13 connected by a hose, not shown in the drawings, to a central wind tunnel, not shown in the drawings, for pumping air, with filtration if desired, into the room.

At the outlet of this heating tube 11, is provided a tube 11, for smoke suction, also connected by a hose to the central suction device, not shown in the drawings, that expels the loaded air directly to the outside, or if desired after passage through an anti-pollution duct.

A flattened U-shaped connecting tubular portion 15, is more particularly illustrated in FIGS. 2, 3, and 4.

Rectilinear cooling tube 16 consists of a stainless steel tube having a length of about 1.5 meter and a diameter of about eight millimeters, sliding freely, for instance over forty-five millimeters, approximately, upwards and downwards, in two stainless steel stationary bearings 23 and 24.

False-twist spindle 17 can be of any type, either mechanical, magnetic or frictional by means of rings or discs, as illustrated.

A second yarn delivery 18, may or may not be similar to the first yarn delivery 8, and the speed ratio between delivery 8 and 18 is conventionally adjusted according to a steady and predetermined ratio, depending upon whether it is desired to have the yarn stretched or released during the treatment, by means of a gear train or similar apparatus provided at the drive end of the system.

A set of counter-bars or counter-guides 19 and 20 are present, which in a preferred embodiment, can be replaced by tubes permitting pneumatic passage of the yarn.

A winding device, chiefly comprises a rotary pilot-roller 21, bearing the winding support gripped between the two ends thereof, and then bobbin 22 that is being formed.

In a form of the invention not illustrated, but adapted for sequential drawing texturation, the machine additionally comprises, above the delivery 8, a further yarn delivery and a drawing finger, or pin, the ratio between the speed of the latter delivery and the delivery 8 being adjusted in accordance with the drawing rate desired.

Referring now to FIGS. 2, 3, and 4, the connecting tubular part or portion 15 consists of a stainless steel tube 25 with an inside diameter of about eight millimeters, said tube being approximately an elongated, flattened U-shaped configuration, with the end of the leg that is to come into contact or engagement with the outlet 30 of the heating tube 11 having a tip 26 made of flexible elastomer material for instance, and being conveniently shaped to be plugged into said outlet, the other leg of this tube 25 being linked as shown at 27, to the inlet of the cooling tube 16 with which this leg is connected. This tube 25, which has a length of about five hundred millimeters, is pivoted at 28 around an axis that is approximately orthogonal to the longitudinal axis of the heating tube, to bring the tip 26 into close contact with the end 30 of the outlet of the tube 11. A metal mass 29, of cast iron for example, placed between tip 26 and axis 28, makes it possible, in the absence of pressure, to have the tube 25 spaced automatically from the outlet 30 of the tube 11, when the pulling step is completed. Any other equivalent means may be substituted for this mass, such as a spring, etc.

Finally, at the ends of each leg of the U, there are provided ceramic guides 31 and 32 to prevent friction of the yarn on the inside face of tube 25 where the yarn changes directions. A manifold 33, (FIG. 2) connected to air suction 34 (FIG. 1) disposed adjacent to the second leg of the U with respect to the feeding direction of the yarn, and connected to a suction turbine, not illustrated in the drawings, removes the smoke that is carried along by the yarn during its travel.

In practice, this manifold 33, connected directly onto cooling tube 16, comprises a flexible joint connected to collector 34.

In another example, shown in FIG. 3, the tip 26 obturates the aperture 14 to follow the shape of the conical outlet 30 of the heating tube 11. This disposal decreases the loss of head originally caused by suction tube 14, and improves the pneumatic thread-up of the yarn.

In another sample, shown in FIG. 4, the manifold 33 connected to the air suction 34 is located in the lower part of the leg of the connection tubular portion 15.

A texturation machine of this kind is started as follows:

Conventionally, by means of an air depressing pulling pneumatic gun connected to a turbine or to another similar device, the yarn 5 is taken from the bobbin 2, then passed over the devices 6, 7, and 8, and the end of the yarn being then placed on the guide 9.

The gun is then presented at the outlet 35 of the cooling tube 16, and an axial pressure is applied by hand on the end of this tube, to allow tube 16 to slide downwards in the bearings 23 and 24. This pressure must be sufficient to counter-balance the mass 29. The tube 16, while sliding downwards, causes the connecting tube 25 to be pivoted around axis 28 until the tip 26 is brought into close contact or engagement with the outlet port 30 of the heating tube 11.

The free end of the yarn is placed at 9 near the tube 10, and the delivery 8 is caused to come into gear. The yarn is sucked in at 35 by the automatic hand suction gun positioned at outlet 35. The pressure at 35 is then released so that under the action of the return mass 29, the tube 25 tilts and causes the cooling tube 16 to move upwards to its original position. The delivery 8 is then disengaged, the yarn is passed by hand through the spindle 17, into the second delivery 18, onto the bar assemblies 19 and 20, and finally, the yarn is received on the bobbin 22 either manually, or pneumatically temporarily by means of a device that is well known under the tradename "DOFIL".

This improved installation has many advantages, and provides more particularly the possibility of threading-up of the yarn by a pneumatic process in high speed false twist texturation machines.

It is understood that, within the scope of the present invention, the texturation machine can have a second refixing zone or other known devices for texturation.

This invention is particularly adapted to the texturation machines described in U.S. Pat. No. 3,501,904, in which the heating tube and the cooling tube form the two legs of a U-shape, connected together.

What is claimed is:

1. In a false-twist yarn texturing machine having a plurality of treatment positions wherein each treatment position comprises essentially: a yarn feeding device, a first yarn delivery carriage, a heating tube, a cooling tube, a false-twist spindle, a second yarn delivery carriage, and a winding device, an air blowing device located at the inlet of the heating tube, and a suction means for disposing of smoke located at the outlet of said heating tube, wherein the improvement comprises:

a tubular connection located between the outlet of said heating tube and the inlet of said cooling tube, said tubular connection being mounted for pivoting around a linking axis which is approximately orthogonal to the longitudinal axis of said heating tube, for thereby temporarily bringing one end of said tubular connection into engagement with the outlet of said heating tube, and means for permitting said cooling tube to slide in the direction of its own longitudinal axis, the inlet of said cooling tube being engaged with the other end of said tubular connection.

2. The yarn texturing machine of claim 1 wherein the cooling tube is approximately parallel to the heating tube, said tubular connection is approximately U-shaped the end of one of the legs of the U of said U-shaped connection adapted for engagement with the outlet of said heating tube during yarn threading through the machine, the other leg of the U-shaped connection being permanently connected to the inlet of the cooling tube.

3. The yarn texturing machine of claim 2, additionally comprising another suction means for disposing of smoke, connected to the tubular connection near the bottom of said other leg of the U-shaped connection.

4. The yarn texturing machine of claim 1, additionally comprising another suction means for disposing of smoke, connected to the tubular connection near the inlet of the cooling tube.

5. The yarn texturing machine of claim 1, additionally comprising means for return-pivoting said tubular connection about said linking axis for thereby disengaging said one end of the connection from the outlet of the heating tube.

6. The yarn texturing machine of claim 5, wherein said return-pivoting means comprises a mass attached to said tubular connection between said one end thereof and said linking axis.

7. The yarn texturing machine of claim 1 wherein said one end of the tubular connection is shaped for engagement with a complimentarily shaped outlet end of the heating tube.

8. The yarn texturing machine of claim 7, wherein the shaped one end of the tubular connection is shaped for obturating a connection to said suction means for disposing of smoke, at the same time that it is in engagement with the outlet end of the heating tube.

* * * * *